US009194284B2

(12) United States Patent
Gratton et al.

(10) Patent No.: US 9,194,284 B2
(45) Date of Patent: Nov. 24, 2015

(54) RESERVOIR PRESSURIZATION

(71) Applicant: Deere & Company, Moline, IL (US)

(72) Inventors: Michael R. Gratton, Dubuque, IA (US); Grant R. Henn, Dubuque, IA (US); Bryan J. Huttenlocher, Dubuque, IA (US)

(73) Assignee: DEERE & COMPANY, Moline, IL (US)

( * ) Notice: Subject to any disclaimer, the term of this patent is extended or adjusted under 35 U.S.C. 154(b) by 0 days.

(21) Appl. No.: 14/220,732

(22) Filed: Mar. 20, 2014

(65) Prior Publication Data

US 2015/0247451 A1 Sep. 3, 2015

Related U.S. Application Data

(60) Provisional application No. 61/946,264, filed on Feb. 28, 2014.

(51) Int. Cl.
*F02B 33/44* (2006.01)
*F02B 47/08* (2006.01)

(52) U.S. Cl.
CPC ..... *F02B 47/08* (2013.01)

(58) Field of Classification Search
None
See application file for complete search history.

(56) References Cited

U.S. PATENT DOCUMENTS

| | | | | |
|---|---|---|---|---|
| 3,592,175 | A * | 7/1971 | Hamilton | 123/446 |
| 3,846,983 | A | 11/1974 | Freedy et al. | |
| 4,162,615 | A | 7/1979 | Grattapaglia et al. | |
| 4,164,919 | A * | 8/1979 | Davis et al. | 123/434 |
| 4,551,973 | A | 11/1985 | Broadhead | |
| 5,421,310 | A | 6/1995 | Kapich | |
| 6,145,860 | A | 11/2000 | Yu et al. | |
| 6,240,721 | B1 * | 6/2001 | Ito et al. | 60/274 |
| 6,532,910 | B2 | 3/2003 | Langervik | |
| 8,250,861 | B2 | 8/2012 | Schwark et al. | |
| 2002/0069011 | A1 * | 6/2002 | Hawkins et al. | 701/104 |
| 2004/0206083 | A1 * | 10/2004 | Okuyama et al. | 60/608 |
| 2006/0042241 | A1 * | 3/2006 | Bright et al. | 60/431 |
| 2008/0059048 | A1 * | 3/2008 | Kessler et al. | 701/103 |
| 2009/0143958 | A1 * | 6/2009 | Parker et al. | 701/104 |
| 2011/0308484 | A1 | 12/2011 | Peterson et al. | |
| 2014/0083087 | A1 | 3/2014 | Mount | |
| 2015/0218779 | A1 * | 8/2015 | Mitchell et al. | 61/411 |

* cited by examiner

*Primary Examiner* — Jesse Bogue

(57) ABSTRACT

A vehicle comprises a forced induction engine, fluid reservoir, engine controller, and sensor. The fluid reservoir is pneumatically connected to intake air of the forced induction engine. The engine controller is in communication with the forced induction engine and configured to control the forced induction engine. The sensor is in communication with the engine controller and is configured to measure a pressure within the fluid reservoir and communicate it to the engine controller. The controller is configured to derate the engine when the pressure within the fluid reservoir is above a first pressure.

20 Claims, 4 Drawing Sheets

RESERVOIR PRESSURIZATION

FIELD OF THE DISCLOSURE

The present disclosure generally relates to a fluid reservoir that may be pressurized by the intake air of a forced induction engine.

BACKGROUND

Vehicles may utilize fluid reservoirs to collect various fluids, such as hydraulic fluid, engine oil, or coolant. For certain vehicles, or certain applications of a vehicle, it may be desirable to pressurize the fluid reservoir above atmospheric pressure. This may improve the performance of, or avoid damage to, components which draw fluid from the fluid reservoir. The fluid reservoir may be pressurized using the intake air of a forced induction engine.

SUMMARY

According to an aspect of the present disclosure, a vehicle may comprise a forced induction engine, fluid reservoir, engine controller, and sensor. The fluid reservoir may be pneumatically connected to intake air of the forced induction engine. The engine controller may be in communication with the forced induction engine and configured to control the forced induction engine. The sensor may be in communication with the engine controller and may be configured to measure a pressure within the fluid reservoir and communicate it to the engine controller. The controller may be configured to derate the engine when the pressure within the fluid reservoir is above a first pressure.

According to another aspect of the present disclosure, a method of controlling a vehicle with a fluid reservoir and an engine may comprise sensing a pressure within the fluid reservoir and derating the engine when the pressure is greater than a first pressure.

According to another aspect of the present disclosure, a vehicle may comprise a forced induction engine, fluid reservoir, sensor, pneumatic line, first pneumatic check valve, second pneumatic check valve, and a controller. The sensor may be configured to measure a pressure within the fluid reservoir. The pneumatic line may comprise a first pneumatic check valve and may be pneumatically connected to the fluid reservoir and intake air of the forced induction engine. The first pneumatic check valve may be configured to allow air flow from intake air of the forced induction engine to the fluid reservoir at a first pressure. The second pneumatic check valve may be pneumatically connected to the fluid reservoir and the atmosphere, and may be configured to allow air flow from the fluid reservoir to the atmosphere at a second pressure, where the second pressure greater than the first pressure. The controller may be in communication with the engine and the sensor and may be configured to derate the engine when the pressure within the fluid reservoir is above a third pressure, where the third pressure is greater than the second pressure.

The present disclosure relates to a reservoir that may be pressurized by intake air of the vehicle's engine instead of by an additional component, hydraulic actuation, or a temperature change. For certain vehicles and applications, this may allow for more consistent pressurization, including less variance based on altitude, temperatures, and vehicle usage. The present disclosure also relates to derating the engine or components drawing fluid from the reservoir, such as a hydraulic pump, when the pressure within the reservoir falls outside a pressure band.

The above and other features will become apparent from the following description and accompanying drawings.

BRIEF DESCRIPTION OF THE DRAWINGS

The detailed description of the drawings refers to the accompanying figures in which.

DETAILED DESCRIPTION

Figure 1:
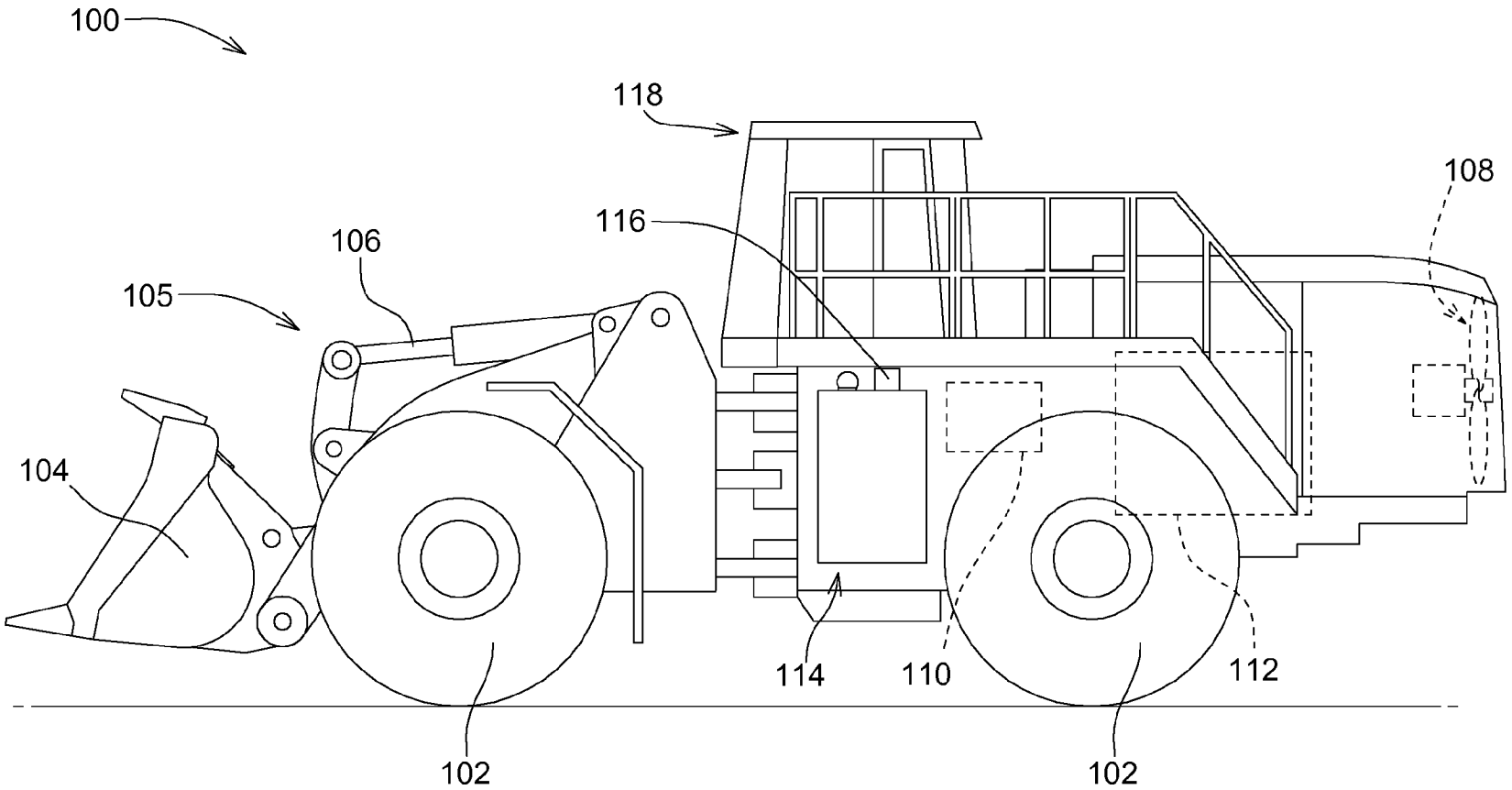
FIG. 1 is a left side elevation view of a vehicle with a hydraulic reservoir.

FIG. 1 illustrates vehicle 100, comprising wheels 102, tool 104, tool linkage 105, tool cylinder 106, hydraulic fan assembly 108, hydraulic pump 110, engine 112, hydraulic reservoir 114, hydraulic filter 116, and operator station 118.

Vehicle 100 is a wheel loader, but the vehicle may also be another vehicle with a fluid reservoir, for example, a backhoe loader, crawler, excavator, feller buncher, forwarder, harvester, knuckleboom loader, motor grader, scraper, skidder, skid steer loader, track loader, or truck. The powertrain of vehicle 100 engages the ground through wheels 102, of which there are four, which roll on the ground and provide support and traction for vehicle 100.

Tool 104 is positioned at the front end of vehicle 100 and is connected to vehicle 100 by tool linkage 105. Tool 104 is a hydraulically actuated bucket which may be loaded with material, such as dirt, gravel, or rock. Tool 104 has two pivotal connections to tool linkage 105, enabling tool linkage 105 to control both the height and rotation of tool 104. Tool linkage 105 consists of multiple rigid members, many of which are pivotally connected to each other, that transfer forces between tool 104 and the remainder of vehicle 100. An example of a tool linkage for a wheel loader is disclosed in U.S. Pat. No. 8,386,133, issued Feb. 26, 2013, which is incorporated herein by reference. Tool cylinder 106 is pivotally connected to tool linkage 105, through which it actuates and controls one aspect of tool linkage 105, the aspect which controls the rotation of tool 104. This aspect may be referred to as bucket curl and bucket dump. Additional hydraulic cylinders (not shown) may actuate and control another aspect of tool linkage 105, the aspect which controls the height of tool 104. This aspect may be referred to as boom raise and boom lower. Tool cylinder 106 is a hydraulic double-acting cylinder with a pivotal connection at each of its ends. Tool cylinder 106 may thereby be used to actuate tool 104. Tool cylinder 106 is referred to as "double-acting" because it may, depending on how it is being hydraulically controlled, generate force tending to extend tool cylinder 106 or force tending to retract tool cylinder 106. When tool cylinder 106 extends, tool 104 curls, or rotates clockwise when viewed from the left such that the front of tool 104 moves upwards and material is trapped by gravity within tool 104. When tool cylinder 106 retracts, tool 104 dumps, or rotates counterclockwise when viewed from the left such that the front end of tool 104 moves downwards and material is ejected from tool 104 by gravity. Vehicle 100 includes other hydraulic cylinders, including those controlling the height of tool 104 and the steering of vehicle 100.

Hydraulic fan assembly 108 is positioned near the rear end of vehicle 100. Hydraulic fan assembly 108 may generate airflow across and through cooling components such as heat-exchangers for hydraulic fluid (e.g., hydraulic oil), air conditioning refrigerant, engine coolant, engine oil, axle oil, and intake air, to name but a few possible fluids that may be cooled by hydraulic fan assembly 108. Hydraulic fan assembly 108 includes a hydraulic motor which rotates the fan blades and is supplied with hydraulic flow by a control valve which in turn is supplied with hydraulic flow by hydraulic pump 110. The rotation of the fan blades draws air from an interior area of the chassis of vehicle 100 and expels it out the rear of vehicle 100.

Hydraulic pump 110 is located in an internal area of the chassis of vehicle 100, below cab 120 and forward of engine 112. Hydraulic pump 110 is a variable displacement pressure-compensated load-sensing axial-piston hydraulic pump that is mechanically driven by engine 112. Alternative embodiments may utilize one or more of a number of alternative hydraulic pump types, including vane, gear, or radial piston, to name but a few types, and may be of a fixed displacement or variable displacement type. Hydraulic pump 110 is rotationally coupled to engine 112 via a spline of hydraulic pump 110 meshing with gearing which ultimately meshes with the crankshaft of engine 112.

Engine 112 is positioned rearward of hydraulic pump 110 in an internal area of the chassis of vehicle 100. Engine 112 is a forced induction diesel engine which provides mechanical power that hydraulic pump 110 converts into hydraulic power that is distributed to various components of vehicle 100, including tool cylinder 106 and hydraulic fan assembly 108. Hydraulic pump 110 is fluidly connected to hydraulic reservoir 114 such that it draws hydraulic fluid from hydraulic reservoir 114 and outputs it at pressure to hydraulic circuits of vehicle 100.

A "forced induction" engine means an engine with a component capable of compressing intake air and thereby boosting its pressure above atmospheric pressure, such as a supercharger or turbocharger. Such an engine may be referred to by different terms, such as a boosted engine, charged engine, supercharged engine, turbocharged engine, or forced induction engine. A forced induction engine need not always operate with intake air at a pressure greater than the surrounding atmosphere, and may operate with intake air at or below atmospheric pressure. For example, turbocharged engines may utilize intake air at or below atmospheric pressure when at idle or under low loads while boosting intake air pressure at moderate to high engine loads. In contrast to a forced induction engine, a naturally-aspirated engine lacks a component capable of compressing intake air and instead relies on the partial vacuum created by its pistons during their intake strokes to draw air into the engine. This may cause the pressure of the intake air to be lower than atmospheric pressure, including due to the pressure drop along the air pathway from atmosphere to the cylinder generating the partial vacuum.

Hydraulic reservoir 114 serves multiple purposes on vehicle 100, including the collection, storage, cooling, and deaeration of hydraulic fluid. Hydraulic reservoir 114 comprises mounts for hydraulic filter 116. Hydraulic filter 116 filters hydraulic fluid as it returns to hydraulic reservoir 114 from certain hydraulic circuits on vehicle 100, including those circuits comprising tool cylinder 106 and hydraulic fan assembly 108.

Hydraulic reservoir 114 is positioned below operator station 118 on the left side of vehicle 100. Hydraulic pump 110 is positioned such that its inlet port for drawing hydraulic fluid from hydraulic reservoir 114 will often be higher than the level of hydraulic fluid in hydraulic reservoir 114. If the pressure within hydraulic reservoir 114 is maintained at atmospheric pressure (i.e., the air pressure outside vehicle 100), vacuum pressure will form at the inlet port of hydraulic pump 110 as it draws hydraulic fluid up from hydraulic reservoir 114. Pressure losses along the path from hydraulic reservoir 114 to hydraulic pump 110 may exacerbate the vacuum pressure necessary to maintain flow to hydraulic pump 110, particularly at higher flow rates. Hydraulic pump 110 may be designed to operate with a minimum inlet pressure, for example 14 pounds per square inch (psi), and may suffer performance degradation or damage, such as from cavitation, if operated below that pressure. To avoid these problems, hydraulic pump 110 may positioned lower on vehicle 100, hydraulic reservoir 114 may be positioned higher on vehicle 100, or the fluid level in hydraulic reservoir 114 may be raised, but these modifications may not be possible or desirable on vehicle 100, including due to packaging constraints, cost, or the design of hydraulic reservoir 114. Alternatively, hydraulic reservoir 114 may be pressurized so that the hydraulic fluid is kept at a pressure greater than atmospheric.

Pressurizing hydraulic reservoir 114 may allow hydraulic pump 110 to be positioned higher than the fluid level of hydraulic reservoir 114 while maintaining a target inlet pressure to hydraulic pump 110. Pressurizing hydraulic reservoir 114 may allow for greater freedom in the positioning of hydraulic reservoir 114 and hydraulic pump 110, but it requires hydraulic reservoir 114 to be designed to withstand a greater pressure and requires a method of pressurizing hydraulic reservoir 114. Hydraulic reservoir 114 may be pressurized via a number of different methods. One method is to utilize a dedicated pressurizing component, such as an air compressor connected to the atmosphere, to add or remove fluid from within hydraulic reservoir 114 until the desired pressure is achieved. Another method is to utilize an air breather that allows air into hydraulic reservoir 114, but allows air to escape hydraulic reservoir 114 only when it is above the desired pressure. Using an air breather of this type allows hydraulic reservoir 114 to build pressure as vehicle 100 operates due to thermal expansion (i.e., the volume of hydraulic fluid rises as its temperature rises, increasing pressure) or due to changes in the volume of the hydraulic system (e.g., the air breather allows air in as tool cylinder 106 extends and thereby increases hydraulic system volume, but does not allow air out as tool cylinder 106 retracts and thereby decreases system volume, increasing pressure over each cycle of tool cylinder 106). The present disclosure relates to an alternative method, which is to direct pressurized air from engine 112 to hydraulic reservoir 114 to increase its pressure.

Figure 2:
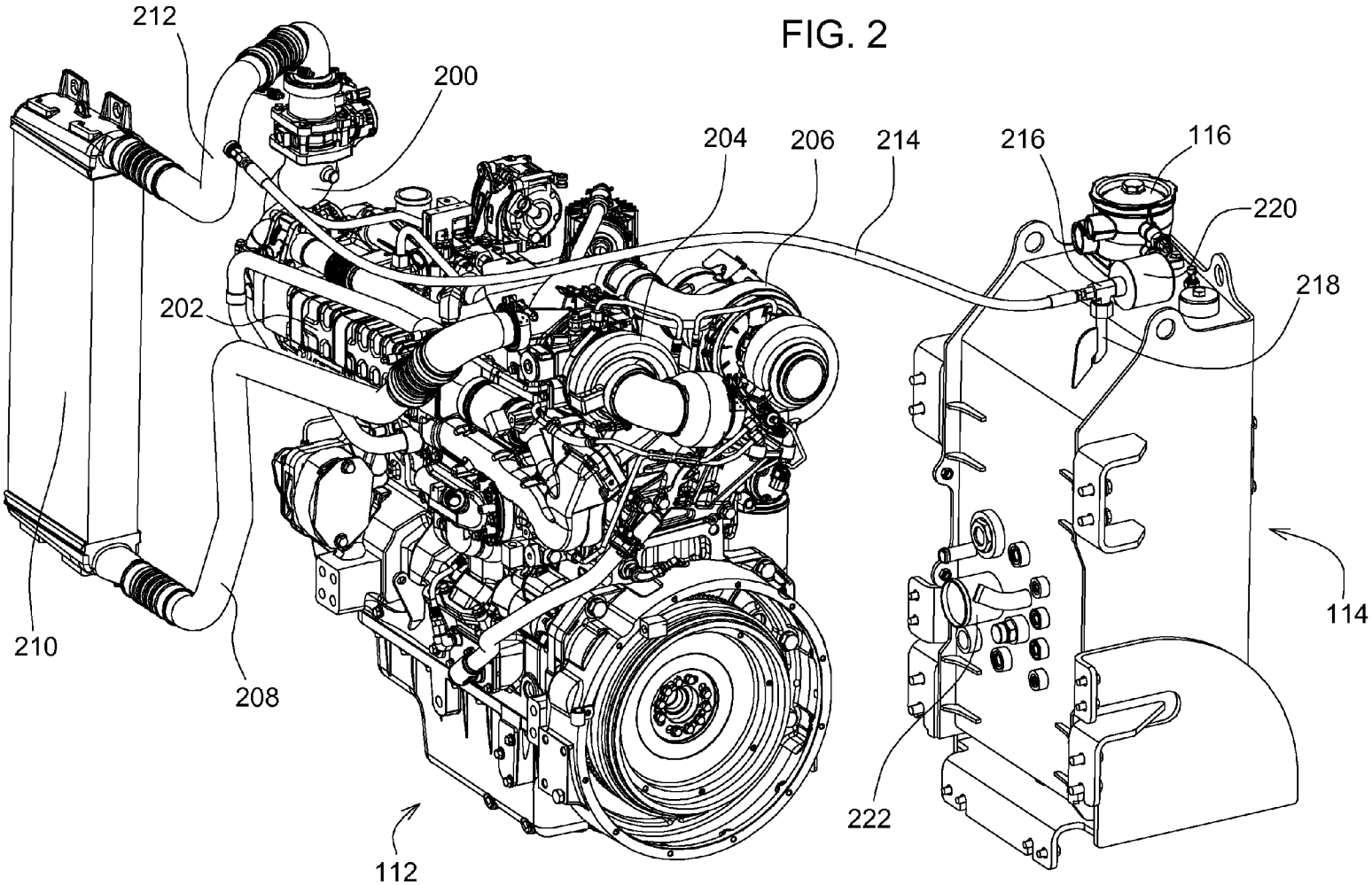
FIG. 2 is a perspective view of a pneumatic connection between a forced induction engine and the hydraulic reservoir.

FIG. 2 illustrates a pneumatic connection between engine 112 and hydraulic reservoir 114. Engine 112 is a turbocharged diesel engine and is therefore a forced induction engine. Engine 112 takes in air for combustion through multiple paths, including through charged air intake 200 and exhaust gas cooler 202. Such intake air may be collected in an intake air manifold (not shown in FIG. 2), which supplies the engine block. After combustion, the exhaust from engine 112 is used by turbocharger 204, turbocharger 206, and exhaust gas cooler 202. Exhaust gas cooler 202 may cool some of the exhaust from engine 112 and return it to the intake air for engine 112. The flow of exhaust through exhaust gas cooler 202 and into intake air for engine 112 may be metered to help control the combustion temperature within engine 112. Exhaust from engine 112 also may turn turbines included in turbocharger 204 and turbocharger 206, and these turbines are mechanically coupled to compressors which compress fresh air (i.e., filtered atmospheric air) which is then sent through charge air cooler supply line 208 to charge air cooler 210. Charge air cooler 210 is an inter-air cooler, or intercooler, which cools the charged (i.e. pressurized) fresh air from turbocharger 204 and turbocharger 206 with atmospheric air and sends it through charge air cooler return line 212. The cooled charged air is then delivered to charged air inlet 200, and from there is may be combined with other intake air and drawn into engine 112 for combustion. Pneumatic line 214 is pneumatically connected to charge air cooler return line 212, and thereby may draw charged cooled air from the intake air of engine 112. Pneumatic line 214 may not always provide charged air, as the air within charge air cooler return line 212 may not be pressurized if turbocharger 204 and turbocharger 206 are not operating or are operating at a low level, such as when engine 112 is at idle or being operated with a low load. A similar forced induction engine is disclosed in U.S. Pat. No. 8,522,757 issued on Sep. 3, 2013, which is incorporated herein by reference. While two turbochargers are used in the embodiment depicted in FIG. 2, alternative embodiments may have a different number of turbochargers or may involve the use of a forced induction engine which obtains charged air in a different manner, such as through the use of a supercharger.

When turbocharger 204 and turbocharger 206 are providing charged air, compressed intake air of engine 112 is available through pneumatic line 214 to hydraulic reservoir 114. Specifically, charged air may travel through pneumatic line 214 to pneumatic connector 216, which pneumatically connects pneumatic line 214, pneumatic port 218, and breather 220. Pneumatic port 218 is pneumatically connected to the interior of hydraulic reservoir 114, and intake air from engine 112 may flow through it to pressurize the interior of hydraulic reservoir 114. Breather 220 may be used to allow air to escape hydraulic reservoir 114 without allowing hydraulic fluid or hydraulic fluid vapor to escape, and may be used to minimize the introduction of contaminants into hydraulic reservoir 114 from the atmosphere. Additional components, specifically pneumatic orifices, check valves, and relief valves, may be installed with pneumatic line 214 to aid in the control of air flows and pressures through pneumatic tube 214 and within hydraulic reservoir 114. These additional components may be installed within, or integral to, the connectors at the ends of pneumatic tube 214, pneumatic connector 216, or breather 220.

Hydraulic reservoir 114 provides a source of hydraulic fluid for a number of components, including hydraulic pump 110 (not shown in FIG. 2). Hydraulic pump 110 fluidly connects to hydraulic reservoir 114 at supply port 222, and through supply port 222 hydraulic pump 110 may draw hydraulic fluid from hydraulic reservoir 114. The pressurization of hydraulic reservoir 114 above atmospheric pressure may allow hydraulic pump 110 to avoid cavitation when drawing hydraulic fluid, as the additional pressure may counteract pressure drops between hydraulic reservoir 114 and hydraulic pump 110 (e.g., drops across supply port 222 and the hydraulic lines between hydraulic reservoir 114 and hydraulic pump 110) and a pressure drop due to positioning hydraulic pump 110 above hydraulic reservoir 114.

Figure 3:
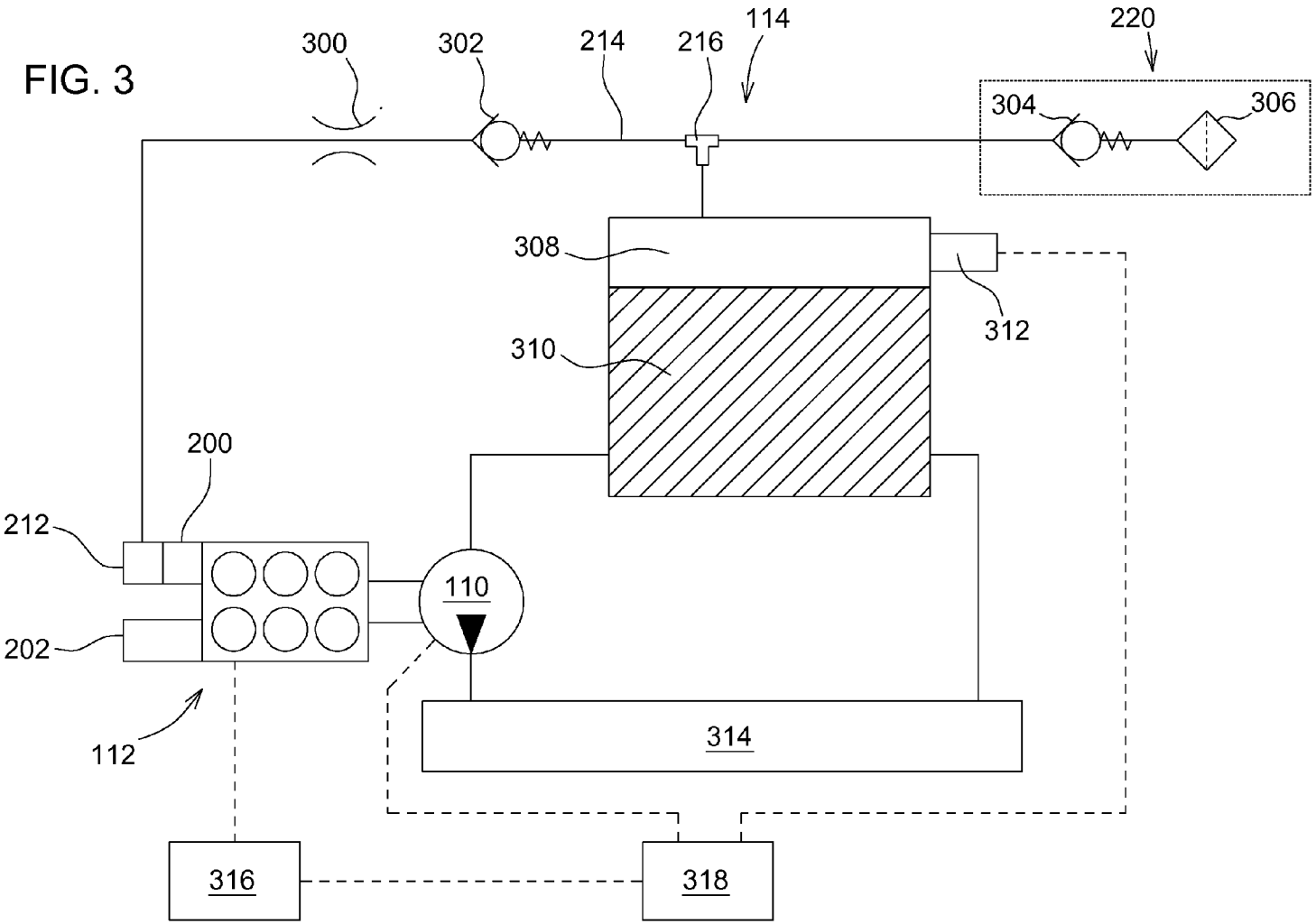
FIG. 3 is a schematic of a reservoir pressurization system.

FIG. 3 is a schematic illustrating portions of the pneumatic pressurization system and hydraulic system of vehicle 100. Engine 112 draws intake air from charge air cooler return line 212 and exhaust gas cooler 202. The intake air within air cooler return line 212 may be pressurized if turbocharger 204 and turbocharger 206 are operating, and if so such air may travel through pneumatic line 214 to hydraulic reservoir 114. Orifice 300 and check valve 302 may be installed where pneumatic line 214 connects to air cooler return line 212. Orifice 300 has a limited cross-sectional area, which will generate a pressure drop across itself that increases with increases in the flow rate through pneumatic line 214. Orifice 300 may be installed in series with pneumatic line 214 to limit the flow rate of pressurized air from the intake air of engine 112 so that engine 112 does not experience a drop in performance due to a limited volume of pressurized intake air. Orifice 300 may also prevent a loss of pressurization on the intake air to engine 112 if the integrity of any components connected to air cooler return line 212 is lost, for example if a hole develops in pneumatic line 214 or check valve 302 ruptures and allows air to escape to atmosphere. Check valve 302 allows air flow from air cooler return line 212 to hydraulic reservoir 114, but prevents air flow in the reverse direction. This may help prevent contaminants and undesired gases from entering the intake air of engine 112. Orifice 300 and check valve 302 may be integrated into either of the connectors which mate to pneumatically connect air cooler return line 212 and pneumatic line 214, or they may be installed in series between air cooler return line 212 and pneumatic line 214.

Pneumatic connector 216 is pneumatically positioned downstream of pneumatic line 214, and provides a connection point for pneumatic line 214 and breather 220. Pressurized air from pneumatic line 214 may enter the interior of hydraulic reservoir 114 through pneumatic connector 216, thereby pressurizing hydraulic reservoir 114. Breather 220 comprises check valve 304 and breather element 306. Check valve 304 permits air flow out of hydraulic reservoir 114 but does not allow air to flow from atmosphere back into hydraulic reservoir 114. Breather element 306 may be comprised of a media which prevents dust and contaminants from entering the system, but allows air to escape without allowing hydraulic fluid or hydraulic fluid vapor to escape. Check valve 304 may be set to require a certain pressure at its inlet before it opens and allows air to escape hydraulic reservoir 114. The maximum pressure within hydraulic reservoir 114 may be limited by appropriately setting the opening pressure of check valve 304. For example, the opening pressure of check valve 304 may be set to 5 psi, which should prevent hydraulic reservoir 114 from reaching pressures over approximately 5 psi.

The interior of hydraulic reservoir 114 includes both air 308 and hydraulic fluid 310. The pressure within hydraulic reservoir 114 may be measured by pressure sensor 312. In alternative embodiments, the pressure of hydraulic fluid 310 may be measured instead of the pressure of air 308. Hydraulic fluid is drawn from hydraulic reservoir 114 by hydraulic pump 110, which supplies pressurized fluid to hydraulic circuit 314. Hydraulic fluid returns from hydraulic circuit 314 back to hydraulic reservoir 114.

Engine 112 is in communication with ECU 316. Such communication is represented by a dashed line between engine 112 and ECU 316. ECU 316 (engine control unit) is a controller which monitors and controls engine 112, and is capable of controlling a number of aspects of the operation of engine 112, including engine speed and torque output. Engine 112 may be in communication with ECU 316 through a wiring harness which connects sensors and control solenoids on engine 112 to ECU 316.

ECU 316, hydraulic pump 110, and pressure sensor 312 are in communication with VCU 318. Such communication is represented by the dashed lines connecting these components. VCU 318 (vehicle control unit) is a controller which monitors and controls a number of components on vehicle 100. VCU 318 may monitor and command engine 112 indirectly through its communication with ECU 316. VCU 318 and ECU 316 may be connected through a CAN (controller area network) which enables the two components to exchange information and commands. VCU 318 may monitor the pressure sensed by pressure sensor 312 and send commands to hydraulic pump 110 and engine 112 based on such pressure. VCU 318 may connect to pressure sensor 312 and hydraulic pump 110 through a wiring harness.

Figure 4:
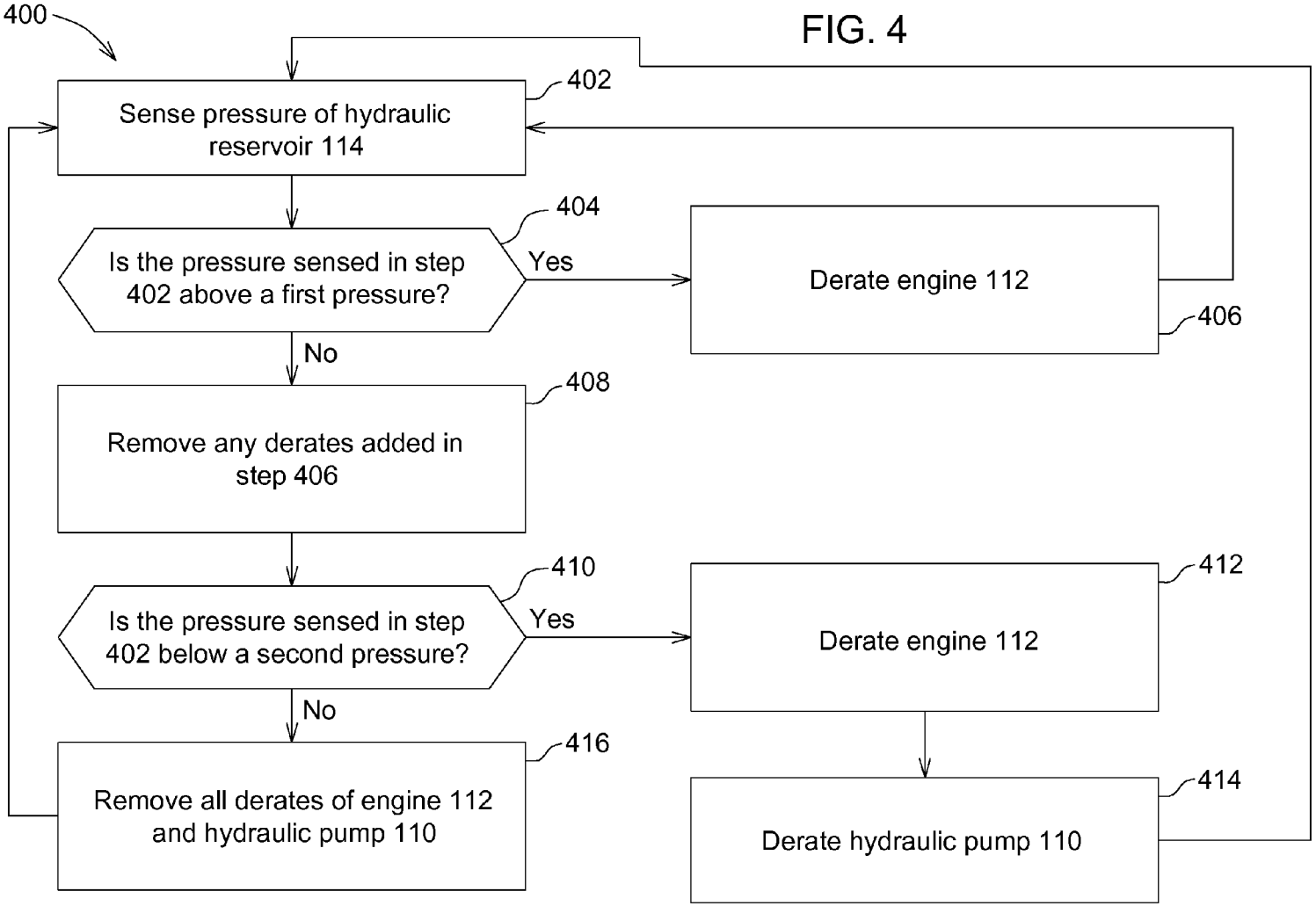
FIG. 4 is a flowchart illustrating a control system for reservoir pressurization.

FIG. 4 is a flowchart illustrating control system 400 for the pressurization of hydraulic reservoir 114. Control system 400 may be stored in the memory of, and be executed on a microprocessor within, VCU 318. In step 402, VCU 318 senses the pressure of hydraulic reservoir 114 by receiving a signal from pressure sensor 312 indicative of a pressure of hydraulic reservoir 114. VCU 318 may process this signal, including by converting it to a particular set of units, adjusting it with offsets such as to compensate for altitude, or filtering it.

In step 404, the sensed pressure of hydraulic reservoir 114 is compared to a first pressure. The value of this first pressure may be based on the maximum pressure which hydraulic reservoir 114 has been designed to sustain in normal operation. For example, this first pressure may be a pressure 2 or 3 psi above the pressure at which check valve 304 allows air flow out of hydraulic reservoir 114, so that step 406 is performed only if it appears that check valve 304 is not operating properly. Alternatively, this first pressure may be set to the pressure at which hydraulic reservoir 114 may begin to experience fatigue or a reduction in expected life due to stresses. This first pressure may also be dynamically set, such as by a calculation which adjusts the first pressure based on the altitude of vehicle 100 and the temperature of the hydraulic fluid. If the pressure of hydraulic reservoir 114 exceeds the first pressure, step 406 is performed next, and if not, step 408 is performed next.

In step 406, engine 112 is derated. VCU 318 sends a derate command to ECU 316, and ECU 316 controls engine 112 pursuant to the derate command. Engine 112 may be derated in a number of manners, including by limiting its speed, torque, or power. This limiting may be achieved by reducing the maximum speed, torque, or power of engine 112, but it may also be achieved by having engine 112 achieve only a proportion of the speed, torque, or power it would achieve absent a derate. For example, derating engine 112 by limiting its torque may entail reducing its maximum torque output to 400 Newton-meters or, alternatively, it may entail having engine 112 produce only 50% of the torque it would normally achieve absent a derate. Derating engine 112 in step 406 may reduce the pressure and flow of air from turbocharger 204 and turbocharger 206, which in turn may reduce the flow or pressure of air traveling through pneumatic line 214 into hydraulic reservoir 114 and prevent hydraulic reservoir 114 from being over-pressurized. Derating engine 112 may prove advantageous for situations where the flow of pressurized air through pneumatic line 214 is greater than the flow of air out through breather 220, such as when intake air in charge air cooler return line 212 is at a higher than normal pressure or where contaminants or component failure is limiting air flow through check valve 304 or breather element 306. After step 406, control system 400 returns to step 402.

If the pressure in hydraulic reservoir 114 was above the first pressure in step 404, then step 408 is performed next. In step 408, any derates added in step 406 are removed, such as those which may have been added during a previous cycle of control system 400. VCU 318 sends a command to ECU 316 to remove these derates, or, in alternative embodiments, VCU 318 continuously sends a derate command to ECU 316 when a derate is desired and ECU 316 will remove any derate upon the termination of this continuous derate command from VCU 318. If control system 400 performs step 408, any over-pressure condition which may have been detected in step 404 and triggered a derate for engine 112 has ceased, and thus the derate may no longer be necessary.

After step 408, step 410 is performed. In step 410, the pressure of hydraulic reservoir 114 is compared with a second pressure, and if the pressure of hydraulic reservoir 114 is below the second pressure, step 412 is performed. This second pressure may be based on the minimum pressure of hydraulic reservoir 114 which is necessary to maintain the inlet of hydraulic pump 110 above the minimum pressure at which it is designed to operate. For example, if hydraulic pump 110 requires 1 psi of pressure at its inlet port to operate properly, the second pressure may be 2 psi, which includes an extra 1 psi to counteract any pressure drops from hydraulic reservoir 114 to the inlet of hydraulic pump 110.

In step 412, engine 112 is derated. In this embodiment, the speed of engine 112 is limited, which in turn will limit the rotational speed of hydraulic pump 110. Limiting the rotational speed of hydraulic pump 110 will limit its flow rate and may limit cavitation, which may help avoid damage to hydraulic pump 110 if the pressure at its inlet is too low due to a low pressure condition in hydraulic reservoir 114.

After engine 112 is derated in step 412, step 414 is performed. In step 414, hydraulic pump 110 is derated. In this embodiment, each of the displacement, pressure, torque, and power of hydraulic pump may be limited. By limiting these factors, the damage taken by hydraulic pump 110 due to low pressure at its inlet and associated cavitation may be reduced, as the flow rate or pressures within hydraulic pump 110 are reduced. Displacement may be limited in a number of ways, including by mechanical displacement limiters and valves which relieve the swash plate piston pressure and thereby destroke hydraulic pump 110. Pressure may also be limited in a number of ways, including by valves which relieve the swash plate piston pressure to destroke hydraulic pump 110 based on the output pressure of hydraulic pump 110 and by valves which relieve the load sense pressure signal sent to hydraulic pump 110. Torque and power may each also be limited in a number of ways, including by components which limit the displacement of hydraulic pump 110 based on its output pressure and rotational speed. Alternative embodiments may not include the necessary components to derate hydraulic pump 110 and may not be include step 414. For example, displacement control is only available on select hydraulic pumps, not all hydraulic circuits contain a modifiable valve which can control the maximum pressure of the hydraulic pump, and not all vehicles contain sensors to measure the power of the hydraulic pump. After step 414 is performed, control system 400 returns to step 402.

If the pressure of hydraulic reservoir 114 was above the second pressure in step 410, step 416 is performed next. If step 416 is being executed, then the pressure of hydraulic reservoir 114 is below the first pressure but above the second pressure, within the designed operating range of hydraulic reservoir 114. In step 416, any existing derates on engine 112 or hydraulic pump 110 are removed as any over-pressure or under-pressure condition detected in a previous iteration of control system 400 has ceased and thus any such derates may no longer be necessary.

Although FIG. 4 is illustrated as a flowchart, the disclosure is not limited to such steps and the order of steps of presented, and it would be well within the skill of one of ordinary skill in the art to reorder, combine, or split many of the steps and achieve the same result. Further, certain steps, such as step 410, step 412, step 414, and step 416, may not be present in all embodiments of the present disclosure.

In this embodiment, step 406, step 412, and step 414 add derates immediately after detecting an over-pressure or under-pressure condition, while step 408 and step 416 remove derates immediately upon detecting that a previous over-pressure or under-pressure condition has ceased. In alternative embodiments, derates may be added or removed only after an over-pressure or under-pressure condition has existed, or ceased existing, for a period of time, such as 5 seconds. Adding time delays to the transitions into and out of derates may reduce instabilities, cycling of derates on and off too aggressively, and derates being added or removed based on transient pressure measurements.

Alternative embodiments may send alerts regarding the status of hydraulic reservoir 114 and any derates which are, or have been, commanded. If hydraulic reservoir 114 is over-pressure or under-pressure, VCU 318 may send a signal to a monitor or indicator lamps in operator station 118 alerting the operator to such a state. A signal may also be sent remotely, such as by radio communication, so that a site manager, service algorithm, or maintenance personnel may be alerted of such pressure states. VCU 318 may also send signals to alert the operator or remote observer regarding which derates have been used or are currently being commanded, which may aid in understanding any performance changes in vehicle 100.

While the disclosure has been illustrated and described in detail in the drawings and foregoing description, such illustration and description is not restrictive in character, it being understood that illustrative embodiment(s) have been shown and described and that all changes and modifications that come within the spirit of the disclosure are desired to be protected. Alternative embodiments of the present disclosure may not include all of the features described yet still benefit from at least some of the advantages of such features. Those of ordinary skill in the art may devise their own implementations that incorporate one or more of the features of the present disclosure and fall within the spirit and scope of the appended claims.

What is claimed is:

1. A vehicle comprising:

a forced induction engine;

a fluid reservoir pneumatically connected to intake air of the forced induction engine, a bottom portion of the fluid reservoir filled with a liquid and a top portion filled with air;

an engine controller in communication with the forced induction engine and configured to control the forced induction engine;

a sensor in communication with the engine controller, the sensor configured to measure a pressure within the fluid reservoir and communicate it to the engine controller;

the controller configured to derate the engine when the pressure within the fluid reservoir is above a first pressure; and a hydraulic pump, wherein the fluid reservoir is a hydraulic reservoir, the liquid is a hydraulic fluid, and the hydraulic pump is hydraulically connected to the hydraulic reservoir so as to draw hydraulic fluid from the hydraulic reservoir.

2. The vehicle of claim 1, wherein the controller is configured to derate the forced induction engine by limiting its speed.

3. The vehicle of claim 1, wherein the controller is configured to derate the forced induction engine by limiting at least one of its torque output or power output.

4. The vehicle of claim 1, wherein the controller is further configured to derate the forced induction engine when the pressure within the fluid reservoir is below a second pressure, the second pressure less than the first pressure.

5. The vehicle of claim 4, wherein the controller is further configured to derate the forced induction engine by limiting its speed.

6. The vehicle of claim 1, further comprising the controller is further configured to derate the hydraulic pump when the pressure within the fluid reservoir is below a second pressure, the second pressure less than the first pressure.

7. The vehicle of claim 6, wherein the controller is configured to derate the hydraulic pump by limiting at least one of its displacement, output pressure, torque, or power output.

8. A method of controlling a vehicle with a fluid reservoir and an engine, comprising, a bottom portion of the fluid reservoir filled with a liquid and a top portion filled with air;

sensing a pressure within the fluid reservoir;

derating the engine when the pressure is greater than a first pressure; and a hydraulic pump, wherein the fluid reservoir is a hydraulic reservoir, the liquid is a hydraulic fluid, the hydraulic pump is hydraulically connected to the hydraulic reservoir so as to draw hydraulic fluid from the hydraulic reservoir, and a controller further configured to derate the hydraulic pump when the pressure within the fluid reservoir is below a second pressure, the second pressure less than the first pressure.

9. The method of claim 8, wherein derating the engine comprises limiting its speed.

10. The method of claim 8, wherein derating the engine comprises limiting at least one of its torque output and power output.

11. The method of claim 8, wherein derating the hydraulic pump comprises limiting at least one of its displacement, output pressure, torque, or power output.

12. The method of claim 8, wherein the derating step further comprises derating the engine only when the pressure is greater than the first pressure for a period of time.

13. The method of claim 12, wherein the period of time is at least 1 second.

14. The method of claim 8, further comprising notifying an operator of a high fluid reservoir pressure when derating the engine.

15. A vehicle comprising:

a forced induction engine;

a fluid reservoir;

a sensor configured to measure a pressure within the fluid reservoir;

a pneumatic line comprising a first pneumatic check valve, the pneumatic line pneumatically connected to the fluid reservoir and intake air of the forced induction engine, the first pneumatic check valve configured to allow air flow from intake air of the forced induction engine to the fluid reservoir at a first pressure;

a second pneumatic check valve pneumatically connected to the fluid reservoir and the atmosphere, the second pneumatic check valve configured to allow air flow from the fluid reservoir to the atmosphere at a second pressure, the second pressure greater than the first pressure; and a controller in communication with the engine and the sensor, the controller configured to derate the engine when the pressure within the fluid reservoir is above a third pressure, the third pressure greater than the second pressure.

16. The vehicle of claim 15, wherein the controller is configured to derate the forced induction engine by limiting its speed.

17. The vehicle of claim 15, wherein the controller is configured to derate the forced induction engine by limiting at least one of its torque output or power output.

18. The vehicle of claim 15, further comprising a hydraulic pump, wherein the fluid reservoir is a hydraulic reservoir, the hydraulic pump is hydraulically connected to the fluid reservoir, and the controller is further configured to derate the hydraulic pump when the pressure within the fluid reservoir is below a fourth pressure, the fourth pressure less than the second pressure.

19. The vehicle of claim 18, where the controller is configured to derate the hydraulic pump by limiting at least one of its displacement, output pressure, torque, or power output.

20. The method of claim 8, further comprising notifying an operator of insufficient fluid reservoir pressure when derating the hydraulic pump.

* * * * *